United States Patent [19]

Nishijima et al.

[11] Patent Number: 4,604,882

[45] Date of Patent: Aug. 12, 1986

[54] FORMING APPARATUS FOR PRODUCTION OF STRANDED CONDUCTOR

[75] Inventors: Tamotsu Nishijima; Toshihiro Fujino, both of Numazu, Japan

[73] Assignee: Yazaki Corporation, Tokyo, Japan

[21] Appl. No.: 603,700

[22] Filed: Apr. 25, 1984

[30] Foreign Application Priority Data

Aug. 12, 1983 [JP] Japan ..... 58-146634

[51] Int. Cl.[4] ..... B21C 37/04; B21C 23/00; B21F 7/00

[52] U.S. Cl. ..... 72/71; 72/254; 72/262; 72/270; 72/272; 140/149

[58] Field of Search ..... 72/262, 254, 256, 261, 72/71, 275, 270, 272; 140/149; 57/138, 311

[56] References Cited

U.S. PATENT DOCUMENTS

| | | | |
|---|---|---|---|
| 3,299,686 | 1/1967 | Lemieux | 72/261 |
| 3,875,779 | 4/1975 | Pugh et al. | 72/262 |
| 4,080,817 | 3/1978 | Bastide | 72/262 |
| 4,471,527 | 9/1984 | Nishijima | 72/256 |

FOREIGN PATENT DOCUMENTS

| | | | |
|---|---|---|---|
| 154590 | 11/1981 | Japan | 140/149 |
| 1533 | 1/1982 | Japan | 72/262 |
| 165215 | 9/1983 | Japan | 72/71 |
| 191537 | 10/1984 | Japan | 72/254 |

*Primary Examiner*—Daniel C. Crane

[57] ABSTRACT

A rotary head for use in an apparatus for forming a stranded wire, the apparatus including an inner rotating body rotating about a predetermined axis, an outer rotating body surrounding the inner rotating body to define an annular space between the two bodies, which rotate about the same axis, and a guide member provided at a first end portion of the annular space to guide wire stock. The rotary head is located at a second end portion of the annular space, has cutters and rotates in a predetermined direction, and also has plural pairs of projections extending on the outer rotating body side of the annular space and the inner rotating body side thereof, with a predetermined gap therebetween, the cutters being provided in the vicinity of the gap.

4 Claims, 6 Drawing Figures

FORMING APPARATUS FOR PRODUCTION OF STRANDED CONDUCTOR

BACKGROUND OF THE INVENTION

The present invention relates to a forming apparatus for the production of a stranded conductor.

Heretofore, stranded conductors have been produced through the following three steps—drawing of coarse wire, annealing and stranding. Consequently, each step has required a large-sized equipment, that is, a large installation space and a large amount of power have been required. Having made extensive studies about the streamlined operations of such conventional stranded conductor manufacturing steps and about the method and equipment for producing a stranded conductor in a single step from the coarse wire drawing, the applicant of the present invention proposed various manufacturing methods and equipment, some of which have already been disclosed in Japanese Patent Application Laid-Open Publication Nos. 154590/81, 1533/82 and 165215/83 and Japanese Patent Application No. 64610/83. For example, in the forming apparatus filed as Japanese Pat. Appln. Laid-open Pub. No. 165215/83 as shown as a partially cut-away perspective view in FIG. 1, wire stock (not shown) fed continuous from a stock inlet 4' of a stock feed guide 4 such as a fixed shoe or the like provided on one side of a stock passage 3 which is formed between an inner rotating body 1 and an outer rotating body 2, both rotating bodies being adapted to rotate coaxially with each other, advances in the form of a coil through the stock passage 3. Before reaching the surface of a rotary head 5 disposed on the other side of the stock passage 3, said wire stock undergoes a compressive stress due to friction induced by the rotating bodies 1 and 2 and action of projections 6 or the like erected circularly on the surface of the rotary head 5 to be thereby heated and undergo a plastic deformation and is formed in the shape of a cylinder. Said cylinder is cut by cutting tools 7 and pushed out in the form of wires through wire passages 8 formed in the rotary head 5. Then the wires are stranded by virtue of rotation of the rotary head 5. In this case, the inner rotating body 1 which is rotated by a shaft 9 and the rotary head 5 which is rotated by a shaft 10, rotate at different speeds, and this difference in rotational speed permits the cutting tool 7 to effect cutting and forming.

FIG. 2 is an enlarged perspective view of the surface of the rotary head 5 shown in FIG. 1, in which the stock which has been cut by a cutting edge 7' of the cutting tool 7 is pushed into the wire passage 8 formed in the rotary head.

In the conventional forming equipment shown in FIGS. 1 and 2, however, the projections 6 erected on an end face 5' of the rotary head 5 are existent on only the outer rotating body side of the stock passage 3. So when the stock which advances toward the rotary head 5 in the form of a coil through the stock passage 3 is formed into a cylinder by compression, it is compressed from the outer rotating body side to the inner rotating body side by the action of the projections 6, thereby causing an excessive friction force on the wall surface of the inner rotating body 1 to the extent that the formation of a cylinder is not effected satisfactorily, with the result that the wire workability and strength may be deteriorated. Further, in the case of using the cut-forming die of FIG. 3 in place of the cutting tool, the diameter of the cutting edge 11 is relatively small as compared with the die body and is too small as compared with the thickness of the cylinder of the stock, therefore, the cutting efficiency of the die for the stock is deteriorated to a large extent. And in the case of a die having the cutting edge 11 of a diameter corresponding to the edge width of the cutting tool, the die body becomes large-sized and it is substantially impossible to attach the die body to the end face 5' of the rotary head 5.

SUMMARY OF THE INVENTION

In view of the above-mentioned problems of the conventional forming equipment, the present invention has been accomplished for the purpose of providing a forming equipment which can overcome those problems and improve the workability of a cylindrical stock to be cut into wire on the rotary head surface and which permits the use of a cut-forming die in place of a cutting tool.

BRIEF DESCRIPTION OF THE DRAWINGS

The forming equipment of the present invention will be described hereinunder with reference to the drawings which illustrate embodiments of the invention, wherein

FIGS. 3*a* and 3*b* show an example of a cut-forming die, in which FIG. 3*a* is a plan view thereof and FIG. 3*b* is a front view thereof;

DETAILED DESCRIPTION OF THE EMBODIMENTS

Figure 1:
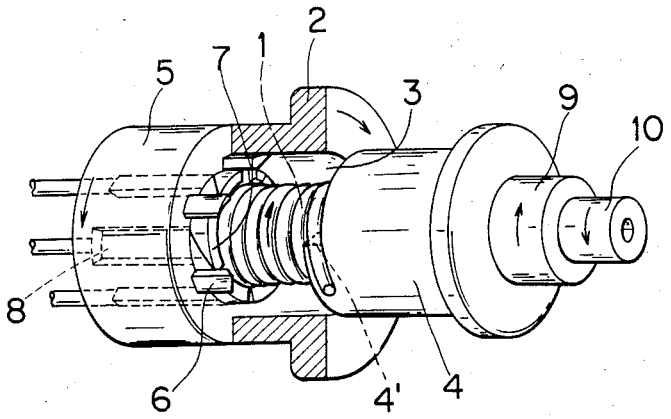
FIG. 1 (PRIOR ART)
FIG. 1 is a partially cut-away perspective view showing an example of a conventional forming equipment for the production of a stranded conductor.
Figure 2:
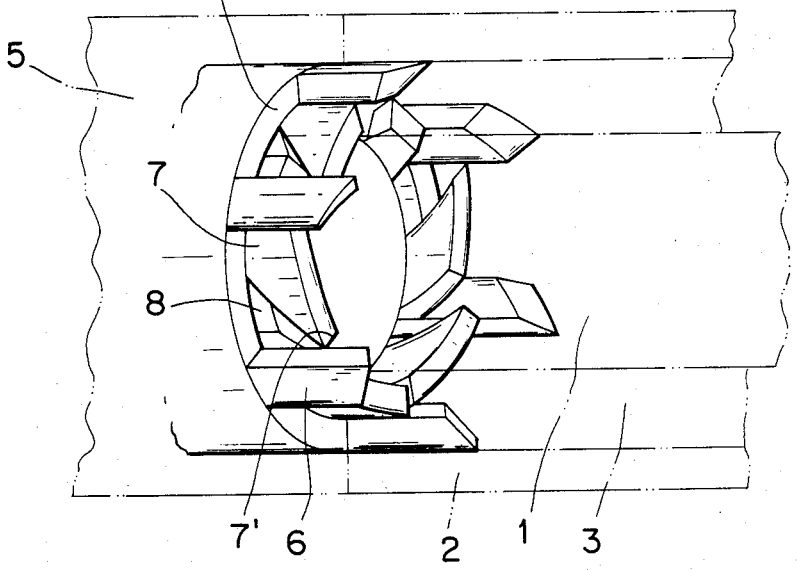
FIG. 2 (PRIOR ART)
FIG. 2 is an enlarged perspective view of the rotary head surface in the forming equipment of FIG. 1.

An explanation of the embodiments of a forming apparatus according to the present invention will be given with reference to the drawings, and referring to FIGS. 1 and 2, the structure which the prior art apparatus and a forming apparatus of the present invention have in common will be explained.

An inner rotating body 1 is provided to rotate about a predetermined axis whereas an outer rotating body 2 is coaxially provided to surround said inner rotating body 1 to define an annular space or stock passage 3 therebetween in cooperation with said inner rotating body 1. At one end portion of said annular space 3 is provided a guide member 4 with a stock inlet 4' for guiding wire stock (not shown) into said annular space. At another end portion of the annular space 3 is provided a rotary head 5 for rotation in a predetermined direction having cut forming means.

Figure 4:
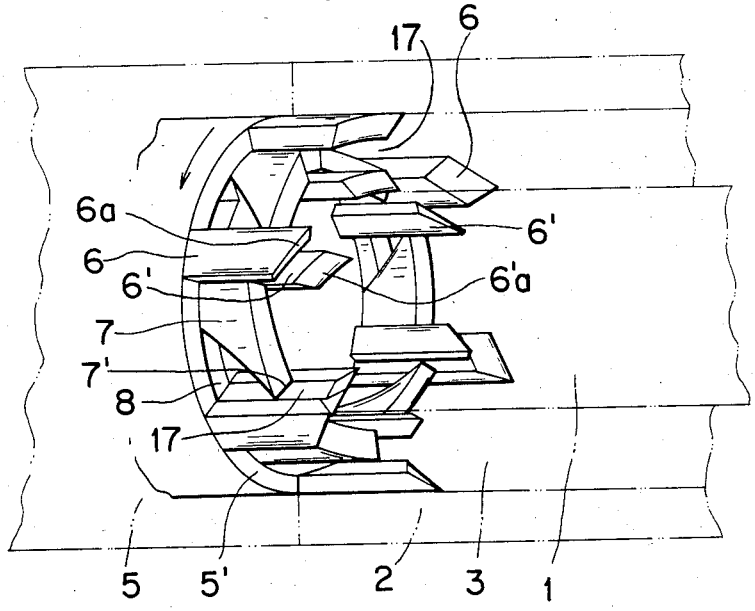
FIG. 4 is a perspective view of principal components of a forming equipment according to an embodiment of the present invention.

In the forming apparatus of the present invention shown in FIG. 4, on one end face 5' of the rotary head 5, an end face of which faces a stock passage 3, there are erected a plurality of projections 6 on the outer rotating body side of the annular space 3, and also on the inner rotating body side thereof there are erected a plurality of projections 6' to form plural pairs of projections, each pair including an inner member and an outer member opposing each other with a predetermined gap 17 therebetween. Further mounted is a cutting tool 7 having a cutting edge 7′ which faces the gap 17 formed between opposed projections 6 and 6′ in each pair, preferably faces the portion of the gap 17 at the rear ends of the opposed projections 6 and 6′ with respect to the advancing direction (the arrowed direction in the figure) of the rotary head 5, namely the rotating direction of the projections. The numeral 8 denotes a wire passage formed within the rotary head 5 through which is pushed out a wire formed from wire stock by cutting and forming with the cutting tool 7.

In order to make it easy to receive a stock and to make the formation of a cylindrical stock easy, it is desirable that upper surfaces 6*a* and 6*a*′ of the paired projections 6 and 6′ be formed with an inclination which faces the advancing direction of the rotary head and an inclination which faces the gap 17 between the opposed projections.

Further, in order to cause the stock to be brought into a half-molten condition, inner rotating body 1 is required to rotate at a different angular speed from outer rotating body 2 in the same direction such that heat is produced in the cylindrical stock due to the friction therebetween. Said cylindrical stock is rotated along with the rotation of inner rotating body 1 and outer rotating body 2. Although in the embodiment of FIG. 4, said stock is rotated against the rotation of the rotary head 5, the stock and the rotary head 5 may rotate in the same direction wherein however the rotary head 5 must rotate at an angular speed higher than the stock in order to prevent the stock from outrunning the cutting edge 7′.

The operation of the forming apparatus of the invention having such construction will now be described. In the same way as in the prior art forming apparatus of FIG. 1, the stock is fed continuously from the inlet 4′ of the stock feed guide 4 into the stock passage 3 formed between inner and outer rotating bodies 1 and 2, then advances toward the rotary head 5 while being wound in the form of a coil with rotation of both rotating bodies, and is then compressed within the gap 17 between the projections 6 and 6′, whereby it is formed in the shape of a cylinder having a wall thickness which corresponds approximately to the width of the gap 17. Just after the forming, the cylindrical stock is cut by the edge 7′ of the cutting tool 7 and then pushed out as wire to the outside through the wire passage 8 in the rotary head 5.

In this case, according to the forming equipment of the present invention, the stock portion on the side of the inner rotating body 1 is also compressed as a cylinder within the gap between the opposed projections 6 and 6′. Consequently, the cylinder thus formed does not contact the inner rotating body 1 and hence does not undergo an excessive friction force induced by the inner rotating body 1. Thus, the cylinder workability is improved to a remarkable extent.

Figure 3A:
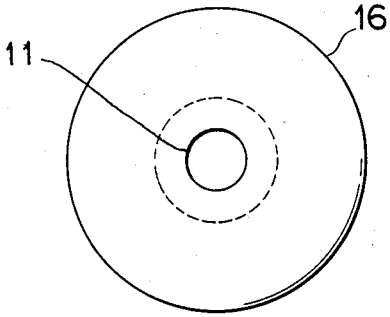
Figure 3B:
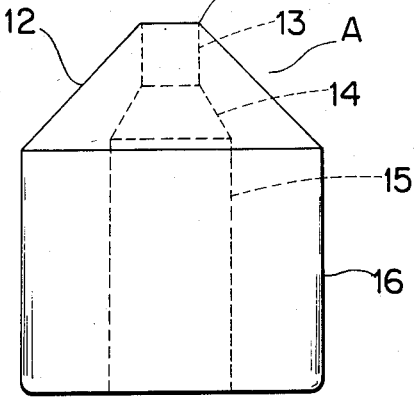

Said cutting tool 7 may be replaced by a cut forming die having a structure as shown in FIG. 3. The cut forming die of FIG. 3 includes a die block A having a conical section 12. Said die block A is bored with a through hole axially with respect to said conical section. Said through hole includes a straight section 13 having a uniform cross sectional area and opening at a top of the conical section 12 of the die block A. Said top of the conical section forms a cutting edge 11. Said die block A further includes a support section 16 contiguously connected to the conical section 12. Said through hole further includes a diverging section 14 diverging from said straight section 13 and an inner groove 15 communicating with said diverging section at one end thereof and opening outside the die block A from the support section 16.

Figure 5:
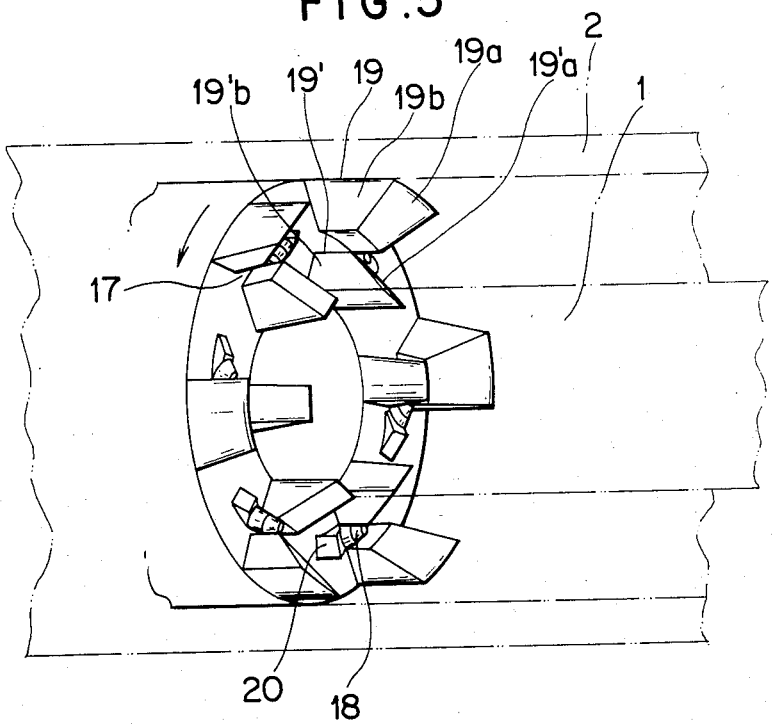
FIG. 5 is a perspective view of principal components of a forming equipment according to another embodiment of the present invention.

FIG. 5 is a perspective view of principal components of the forming apparatus of the present invention in which the cutting tool 7 shown in FIG. 4 is replaced by a cut-forming die 18 of such a structure as shown in FIG. 3.

In FIG. 5, the numerals 19 and 19′ denote plural pairs of opposed projections erected on the rotary head surface extending therefrom. Each pair includes an inner member extending on the inner rotating body side of the annular space and an outer member extending on the outer rotating side thereof. Said inner and outer members oppose each other with a predetermined gap 17 therebetween. Upper surfaces 19*a* and 19*a*′ of the paired projections are each formed with an inclination which faces the gap 17 in order to improve the workability of the cylindrical stock. Faces 19*b* and 19*b*′ facing the rotating direction (the arrowed direction in the figure) of the paired projections 19 and 19′ are each inclined rearwardly toward the gap 17 in order to make it easy to receive the stock. In order that the taking-in and cut-forming of the stock may be performed smoothly by the cutting edge of the die, the die 18 is disposed, inclinedly on a holding stand 20 so that its cutting edge 11 (FIGS. 3*a*, 3*b*) faces the advancing direction of the rotary head 5, the holding stand 20 being embedded inclinedly in the rotary head surface, and it is desirable that the die 18 be positioned so as to face the gap 17 at the rear ends of the opposed pair of projections with respect to the rotating direction of the projections.

In this case, there is obtained a wire whose diameter is almost equal to the diameter of the cutting edge of the die 18. Therefore, if the width of the gap 17 between opposed projections in each pair is adjusted in advance so as to afford a cylindrical stock with a thickness corresponding to the diameter of the cutting edge, there will be little waste of the stock, that is, the cutting efficiency will be improved, and the wire workability can be improved.

As set forth hereinabove, the forming equipment for the production of a stranded conductor of the present invention has a stock insertion guide disposed on one side of a stock passage formed between an inner rotating body and an outer rotating body which are adapted to rotate coaxially with each other, and a rotary head disposed on the other side of the stock passage, the rotary head having a cut-forming means which faces the stock passage, in which one of the plural paired, opposed projections are formed on the side of the inner rotating body and the other projections are formed on the side of the outer rotating body, and in which the cut-forming means is disposed in the vicinity of the gap formed between said opposed projections in each pair. According to the forming equipment of the present invention having such construction, therefore, the stock which has been through the stock passage toward the rotary head is compressed in the gap of the paired opposed projections and is thereby formed into a cylindrical stock having a superior workability, and the taking-in and cut-forming of the stock by cut-forming means such as a cutting tool or a die are performed extremely smoothly. Consequently, the wire thereby obtained has remarkably improved properties, including workability and strength. Further, by presetting the width of the gap between the paired projections to a width equal to the width of the cutting edge of the cutting tool or die used, the stock cutting efficiency can be improved, thus permitting the use of cut-forming dies whose practical application has heretofore been difficult, and easily affording a stranded conductor of good quality. Thus, the present invention has many advantages and effects.

What is claimed is:

1. An apparatus for producing a stranded conductor, said apparatus including a rotary head, an inner rotating body rotating about a predetermined axis, an outer rotating body rotating coaxially with and surrounding said inner rotating body, an annular spaced defined between said two bodies, said bodies having first and second end portions, and a guide member provided at said first end portion for guiding wire stock into said annular space;

said rotary head being coaxially provided at said second end portion for rotation in a predetermined direction, said rotary head having an axial end face at said second end portion and facing said guide member, said rotary head comprising:

plural pairs of projections extending axially from said end face, each pair being radially oriented on said end face and including an inner member extending in said annular space adjacent the inner rotating body and an outer member extending in said annular space adjacent the outer rotating body, said inner and outer members opposing each other with a predetermined gap therebetween; and cut-forming means provided in the vicinity of said gap.

2. An apparatus according to claim 1 wherein said cut-forming means includes a plurality of tools.

3. An apparatus according to claim 1, wherein said cut-forming means includes a plurality of cut-forming dies, each die including:

a die block having a conical section;

said die block having a through hole bored therein axially with respect to said conical section, said through hole including a straight section having a uniform cross sectional area and an opening at a top of said conical section, said top of the conical section forming a cutting edge, said through hole further including a diverging section diverging from said straight section, and an inner groove communicating with said diverging section at one end thereof and opening outside the die block.

4. An apparatus according to claim 1, wherein each projection has a sloping surface facing said gap and said predetermined direction of the rotary head.

* * * * *